US005285549A

United States Patent [19]

Yoshizawa

[11] Patent Number: 5,285,549

[45] Date of Patent: Feb. 15, 1994

[54] DESK TOP CLEANER

[75] Inventor: Keiichi Yoshizawa, Tokyo, Japan

[73] Assignee: Seikosha Co., Ltd., Tokyo, Japan

[21] Appl. No.: 906,724

[22] Filed: Jun. 30, 1992

Related U.S. Application Data

[62] Division of Ser. No. 550,264, Jul. 9, 1990.

[30] Foreign Application Priority Data

Jul. 21, 1989 [JP] Japan ..... 1-190079

[51] Int. Cl.[5] ..... A47L 11/12

[52] U.S. Cl. ..... 15/41.1; 15/47; 15/49.1

[58] Field of Search ..... 15/41.1, 47, 49.1, 52.2, 15/50.2

[56] References Cited

U.S. PATENT DOCUMENTS

| | | | |
|---|---|---|---|
| 966,230 | 8/1910 | Ness | 15/50.2 |
| 1,160,031 | 11/1915 | Adams | 15/50.2 |
| 2,280,077 | 4/1942 | Owen | 15/47 |
| 2,316,709 | 4/1943 | Owen | 15/47 |
| 3,879,788 | 4/1975 | Cousin | 15/45 |
| 4,369,539 | 1/1983 | Nordeen | 15/41.1 |

FOREIGN PATENT DOCUMENTS

| | | | |
|---|---|---|---|
| 556829 | 5/1957 | France | 15/41.1 |

*Primary Examiner*—Harvey C. Hornsby
*Assistant Examiner*—Patrick F. Brinson
*Attorney, Agent, or Firm*—Jordan and Hamburg

[57] ABSTRACT

A desk top cleaner for cleaning dust from the top of a table includes a crankshaft rotatably supported in a frame. A broom is formed with an elongated slot to engage with the crankshaft and has its upper end portion fitted in a supporting portion formed in the frame and its lower end portion equipped with a brush. A drive mechanism is provided for transmitting a rotating force from a drive source to the crankshaft. A dust case for accommodating the dust swept by the broom is included in the frame.

1 Claim, 24 Drawing Sheets

FIG. 7(b)
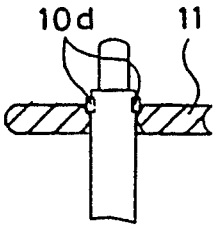
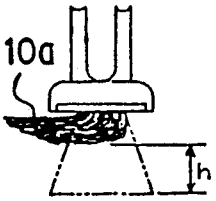
FIG. 7(c)
FIG. 7(a)
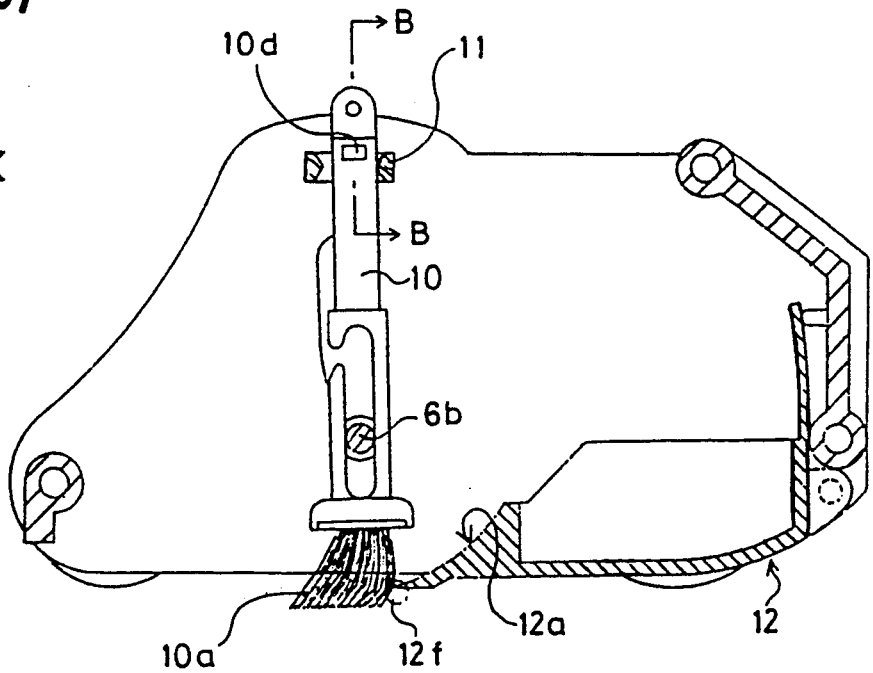

DESK TOP CLEANER

This is a division, of application Ser. No. 07/550,264, filed Jul. 9, 1990.

BACKGROUND OF THE INVENTION

The present invention relates to a desk top cleaner for cleaning fine dust from the top of a desk or table.

In the prior art, a cleaner of this kind is exemplified by both a cleaner for adhering dust of an eraser or the like to an adhesive layer, which is formed on the outer circumference of a roller, and cleaning it off by rotating the roller while pushing it onto the cleaning surface, and a battery type cleaner for sucking the eraser dust by using a fan actuated by a motor.

The cleaner for cleaning the dust by pushing the roller onto the cleaning surface has problems that the adhesion of the adhesive layer of the roller will drop to fail to catch the dust after use for a while and that it cannot intrinsically catch dust of large size.

On the other hand, the cleaner using the motor for sucking the dust has a problem in its high price.

A first object of the present invention is to provide a desk top cleaner inexpensively with a simple structure.

A second embodiment of the present invention is to provide a desk top cleaner which is enabled to give the user a pleasant atmosphere by the rhythmical motions of its broom.

In order to achieve the above-specified object, the desk top cleaner of the present invention provides that a crank shaft is rotatably supported in a frame; that a broom is formed with an elongated slot to engage with the crank shaft and has its upper end portion fitted in a supporting portion formed in the frame and its lower end portion is equipped with a brush; that there is provided a power transmission mechanism for transmitting a rotating force from a drive source to the crank shaft; and that a dust case for accommodating the dust swept by the broom is formed in the frame.

A plurality of brooms may be arranged in parallel with the extending direction of the crank shaft.

The drive source may be at least one wheel attached rotatably to the frame.

The power transmission mechanism is equipped with clutch means for transmitting the one-way rotation of the wheel only.

The power transmission mechanism has its rotation transmission ratio set such that the distance, by which the frame is moved forward by the angle of rotation of the wheels required for the broom to move from a cleaning start position to clear the cleaning surface and to reach the cleaning start position again, is smaller than the cleaning distance of the broom.

The elongated slot of the broom is formed at one portion with a smaller cut portion than the diameter of the crank shaft, and at least one of the members divided from the cut portion is an elastic part, the end portion being formed at the side of the cut portion with a tapered surface.

The broom is equipped at its upper end portion with an engaging portion for regulating the protruding length of the broom from the lower face of the frame.

The dust case is so supported as to rock freely with respect to the frame while having its rocking range restricted by the engaging portion and is equipped with bias means for pushing the dust entrance at its front end portion into contact with the cleaning surface, and the bias means is either a resilient portion formed integrally with one of the frame and the dust case or a moment by the force of gravity around the rocking center of the dust case.

The dust case may be formed integrally with a resilient portion to come into resilient contact with the cleaning surface.

The broom may be equipped with a weight.

The crank shaft may be capable of having its lower end face pushing the lower end portion of the broom.

One of the lower end portion of the broom or the lower end face of the crank shaft is formed integrally with a resilient portion for urging the broom resiliently downward.

The frame is equipped with a selecting member for regulating the size of dust to be swept in.

A plurality of wheels may be rotatably attached to the frame, and a belt may be made to run on the wheels. The power transmission mechanism may be interposed between one of the wheels and the crank shaft.

The drive source may be not only the wheels but also a drive motor mounted in the frame.

If the cleaner thus constructed is moved forward while being pushed onto the cleaning surface, the rotation of the wheel is transmitted to rotate the crank shaft so that the broom is rocked to sweep the dust on the desk top into the dust case.

In case the cleaner is backed, the clutch means terminates the rotation transmission from the wheel to the crank shaft so that the broom is not moved and the dust is not swept back onto the cleaning surface.

Since the rotation transmission ratio is set at the above-specified value, the desk top is not left unswept.

Since the crank shaft is inserted from the cut portion into the elongated slot of the broom, the assembly is facilitated, and unnecessary upward motions of the broom are eliminated.

Since the broom is formed with the engaging portion, it does not protrude downward, if unnecessary, even if the cleaner body is lifted up, to avoid the disadvantages that the broom cannot be rocked or is damaged.

Since the brush at the lower end portion of the broom and the dust entrance of the dust case are pushed to contact the cleaning surface, the dust swept by the broom is smoothly carried into the dust case.

The dust of a size to be carried in is selected by the selecting member so that oversize dust is prevented from invading into the cleaner.

If the belt is made to run on plural belts, the power generated by the advance of the cleaner is transmitted without fail to the crank shaft.

BRIEF DESCRIPTION OF THE DRAWINGS

FIGS. 1–8 show a first embodiment of the present invention in which:

FIG. 1 is a sectional top plan view;

FIG. 2 is a sectional side elevation;

FIG. 3 is a top plan view;

FIG. 4 is a diagram showing the operations of the broom;

FIG. 5 shows at (a) to (d) diagrams for explaining the conditions for setting the rotational transmission ratio;

FIG. 6 is a side elevation of the broom;

FIG. 7(*a*) is a sectional side elevation;

FIG. 7(*b*) is a section taken along line B—B of FIG. 7(*a*);

FIG. 7(*c*) is a side elevation showing a modification of the brush; and

FIG. 8 is a sectional side elevation.

FIGS. 9 and 10 show a second embodiment in which FIG. 9 is a sectional side elevation and FIG. 10 is a front elevation.

FIGS. 11 and 12 show a third embodiment in which FIG. 11 is a sectional side elevation of FIG. 12 is a front elevation.

FIGS. 13 and 14 show a fourth embodiment in which FIG. 13 is a sectional side elevational and FIG. 14 is a front elevation.

FIGS. 15 and 16 show a fifth embodiment in which FIG. 15 is a sectional side elevation and FIG. 16 is a front elevation.

FIGS. 18–20 show a sixth embodiment in which FIG. 18 is a sectional top plan view, FIG. 19 is a sectional side elevation, and FIG. 20 is a top plan view.

FIGS. 21 and 22 show a seventh embodiment in which FIG. 21 is a side elevation and FIG. 22 is a sectional top plan view.

FIGS. 23 and 24 show an eighth embodiment in which FIG. 23 is a sectional side elevation and FIG. 24 is a sectional top plan view.

DESCRIPTION OF THE PREFERRED EMBODIMENTS:

A first embodiment of the present invention will be described with reference to FIGS. 1–8.

Figure 1:
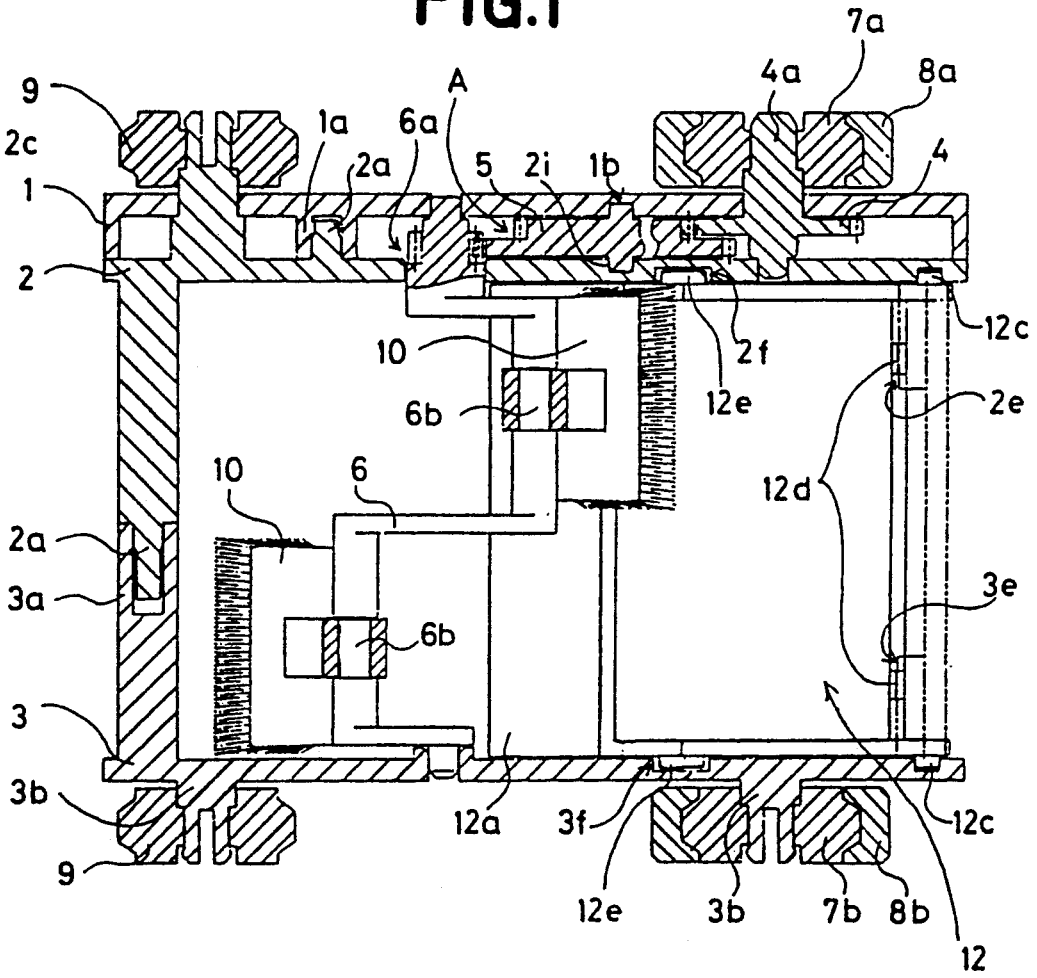
Figure 2:
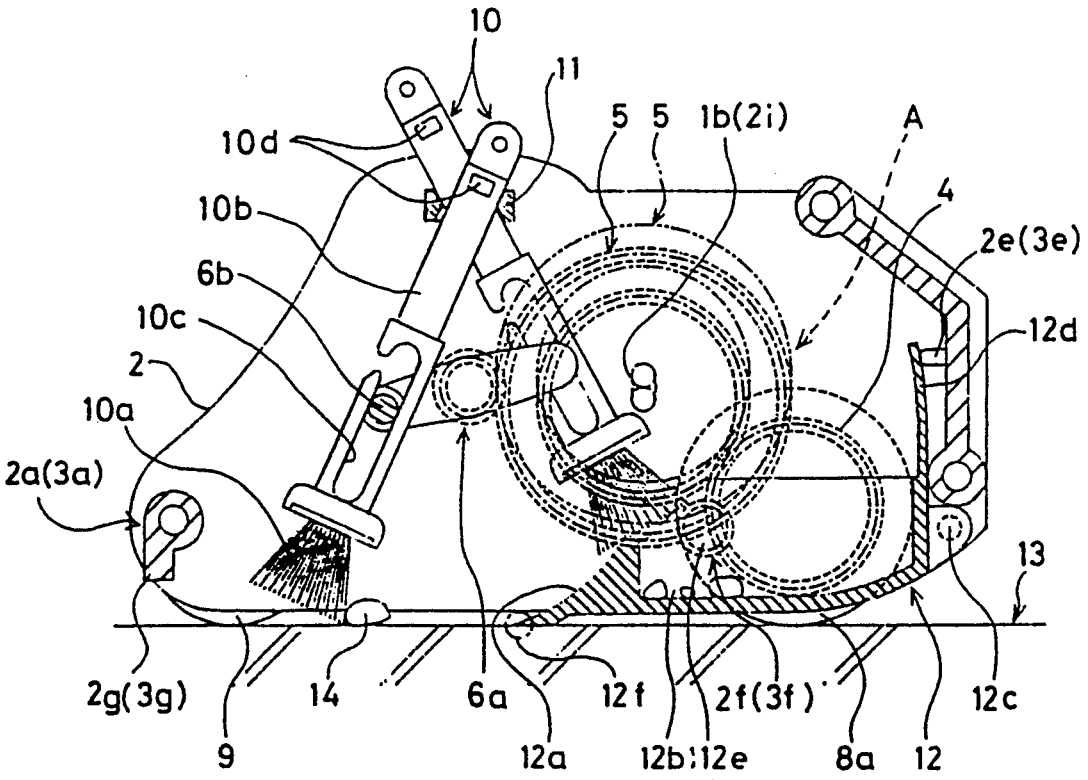
Figure 3:
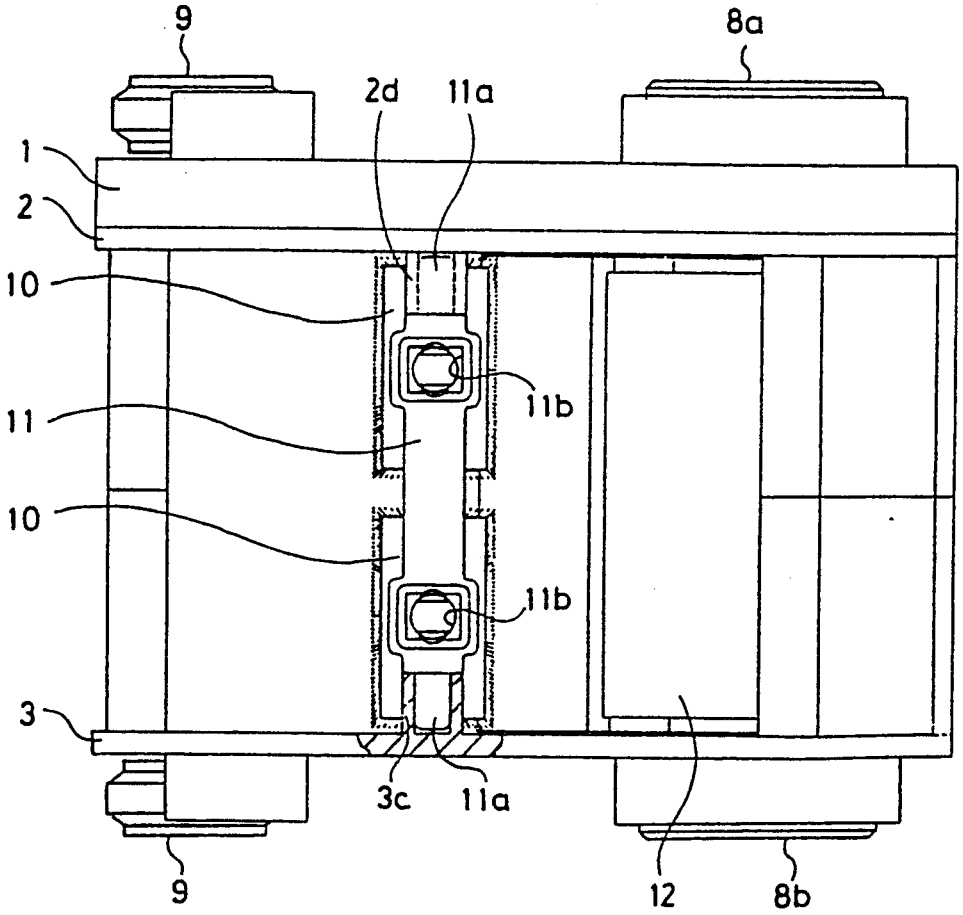

As shown in FIGS. 1—3, a supporting plate 1 and a frame 2 are connected at a predetermined spacing by press-fitting a plurality of pillars 2*a* into corresponding tubular members 1*a*. The frame 2 is also connected at a predetermined spacing by gear 5 which is in meshing engagement with the drive gear 4. A crank shaft 6 is supported between the supporting plate 1 and the frame 3. The crank shaft 6 is formed integrally with a pinion 6*a* which is in meshing engagement with the clutch gear 5. The drive gear 4, clutch gear 5 and pinion 6*a* together constitute a power transmission mechanism A.

The clutch gear 5 is supported by a bearing portion 1*b* on the supporting plate 1 and a bearing portion 21 on the frame 2, which are formed into elongated grooves extending vertically as shown in FIG. 2. The clutch gear 5 constitutes clutch means for transmitting the one-way rotation of the drive gear 4 only to the crank shaft 6, as will be described in detail hereinafter in connection with its operation.

On the shaft 4*a* of the drive gear 4, there is press-fitted a wheel 7*a* which has its outer circumference set with a tire 8*a* made of rubber.

Figure 10:
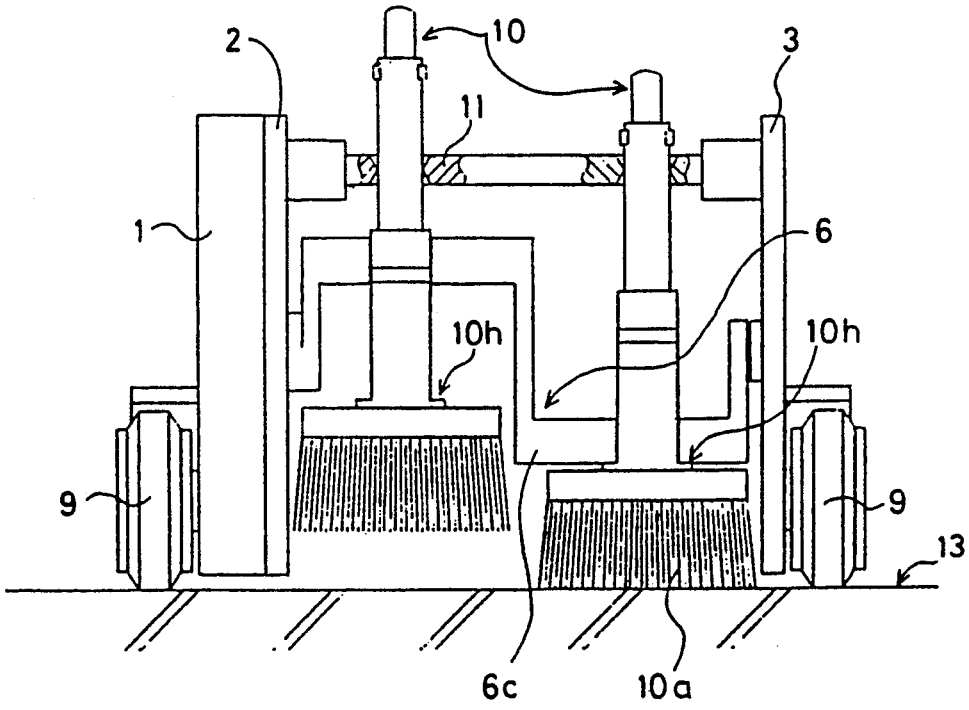

A broom 10 is equipped at its lower end portion with a brush 10*a* as shown in FIG. 10. A grasp portion 10*b* is formed with an elongated slot 10*c*. The broom 10 is formed at its upper end portion with an engaging portion 10*d*.

Through the elongated slot 10*c*, there extends the shaft portion 6*b* of the crank shaft 6, which is freely movable within the elongated slot 10*c*.

Between a pillar 2*d* of the frame 2 and a pillar 3*c* of the frame 3, there are press-fitted both ends 11*a* and 11*a* of a supporting portion 11 as shown in FIG. 3. This supporting portion 11 is formed with openings 11*b* and 11*b*, through which extends the upper end portions of the brooms 10 and 10.

A dust case 12 is formed at its front end portion with a dust entrance 12*a*, as shown in FIGS. 1 and 2, and at its rear end portion with fulcrums 12*c* and 12*c* and resilient portions 12*d* and 12*d*. The dust case 12 provides a dust chamber 12*b* between its front and rear end portions. The dust case 12 is formed at its central portion with engaging portions 12*e* and 12*e*.

The fulcrums 12*c* and 12*c* are borne in the frames 2 and 3, and the engaging portions 12*e* are loosely fitted in recess portions 2*f* and 3*f* of the frames 2 and 3. The resilient portions 12*d* and 12*d* resiliently abut against protrusions 2*e* and 3*e* of the frames 2 and 3. As a result, the dust case 12 can be rocked within a predetermined range counter-clockwise in FIG. 2 so that the leading edge 12*f* of the dust entrance 12*a* is forced into contact with a cleaning surface 13 by the spring forces.

The pillar 2*a* of the frame 2 and the pillar 3*a* of the frame 3 are formed at their lower sides with extending portions 2*g* and 3*g*, as shown in FIG. 2. These extending portions 2*g* and 3*g* constitute together selecting members for selecting dust 14 in accordance with its size.

In order to accomplish the cleaning operation with the desk top cleaner thus constructed, the frames 2 and 3 are grasped to forward the cleaner while engaging the tires 8*a* and 8*b* and the wheels 9 and 9 onto the cleaning surface 13. Then, the tire 8*a* rotates so that the wheel 7*a* and the drive gear 4 accordingly rotate together counter-clockwise in FIG. 2. These rotations are sequentially transmitted to the clutch gear 5 and the pinion 6*a* so that the crank shaft 6 rotates counter-clockwise in FIG. 2.

Figure 4:
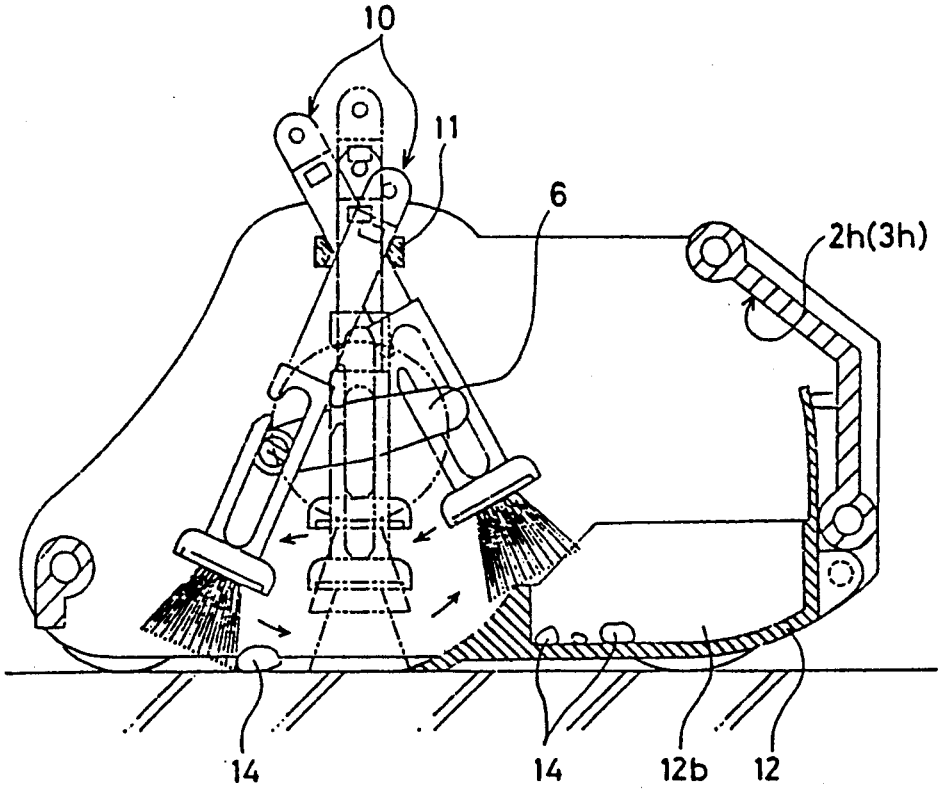
Figure 5A:
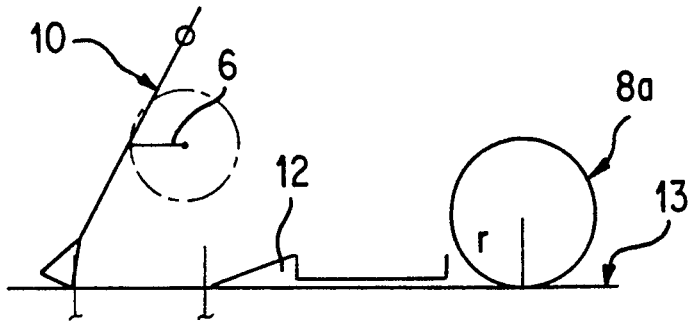
Figure 5B:
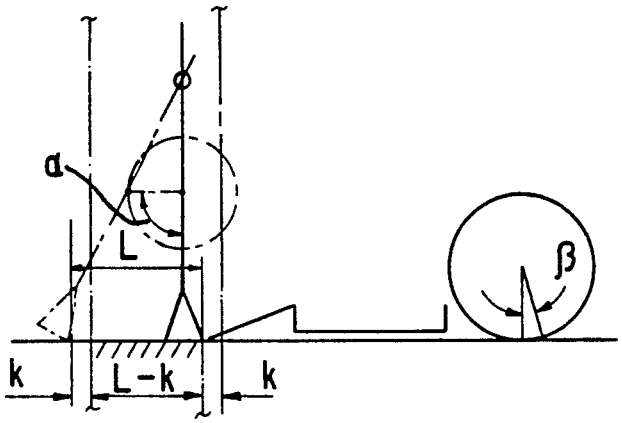
Figure 5C:
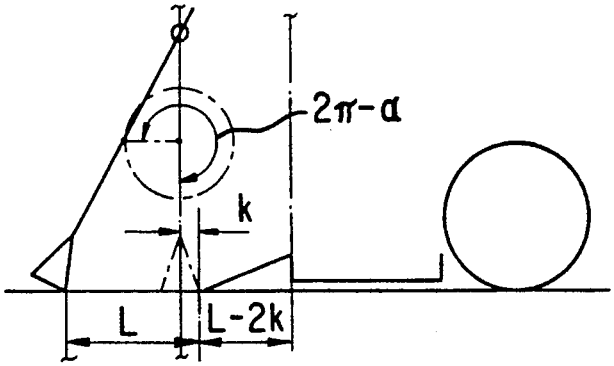
Figure 5D:
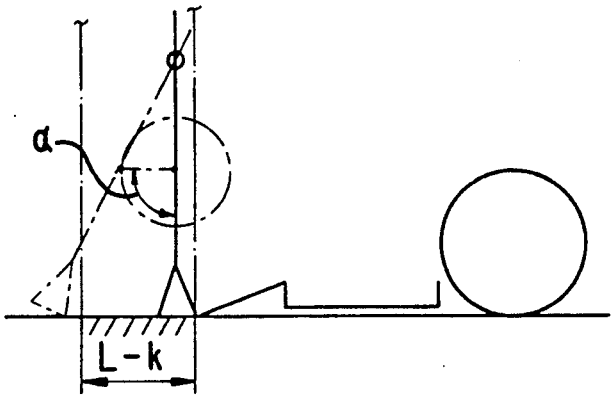

By the rotation of the crank shaft 6, as shown in FIG. 4, the broom 10 is rocked, as shown in FIG. 4, to brush the dust 14 into the dust case 12. At this time, that portion of the dust 14, which is forcibly swept by the broom 10, is brought to impinge upon walls 2*h* and 3*h*, which are formed integrally with the frames 2 and 3, until it drops into the dust chamber 12*b*.

The crank pin 6*b* elevates the broom above the underlying surface to be swept during at least part of the return stroke of the broom.

If the desk top cleaner is backed along the cleaning surface 13, the tire 8*a*, the wheel 7*a* and the drive gear 4 rotate altogether clockwise in FIG. 2 so that the force is transmitted to lift the clutch gear 5 upward of FIG. 2. Thus, the shaft of the clutch gear 5 is moved within the bearing portions 1*b* and 2*i* to a position, as shown by phantom lines in FIG. 2. As a result of this movement, the clutch gear 5 and the pinion 6*a* go out of meshing engagement so that no power is transmitted to the crank shaft 6 and the broom 10.

The conditions for cleaner to run forward without the cleaning surface 13 being left unswept by the broom 10 will be described with reference to FIG. 5.

FIG. 5 shows at (*a*) the status (i.e., the cleaning starting position) in which the broom 10 is going to sweep the cleaning surface.

FIG. 5 shows at (*b*) the status in which the tire 8*a* rotates by an angle $\beta$ to advance the cleaner by a distance k. In this meanwhile, the crank shaft 6 rotates by an angle $\alpha$ so that the broom 10 cleans the cleaning surface 13 by a distance (L−k).

FIG. 5 shows at (*c*) the status in which the cleaner goes forward from the status (*b*) so that the crank shaft 6 rotates by an angle $(2\pi-\alpha)$ to return the broom 10 to the cleaning start position.

FIG. 5 shows at (*d*) the status in which the cleaner advances by the distance k.

Here:

$\gamma$: the radius of the tire 8*a*;

L: the distance by which the broom 10 cleans the cleaning surface during one rotation of the crank shaft;

$\alpha$: the angle of rotation of the crank shaft 6 required for the broom 10 to move over the cleaning surface 13 by the distance L;

K: the distance for the cleaner to run forward when the crank shaft 6 is rotated by the angle $\alpha$; and $\beta$: the angle for the tire 8a to rotate when the cleaner runs forward by the distance k.

In order that the cleaner may run forward without the cleaning surface 13 being left unswept by the broom 10, it is sufficient for the cleaner to advance over the cleaned surface to a position in which the distance k is left. This relation is expressed, as follows:

$$\alpha/k=(2\pi-\alpha)/(L-2k).$$

Here, $k=\beta\gamma$, and the above Equation is rearranged, as follows:

$$\alpha/\beta=\gamma(2\pi+\alpha)/L.$$

Hence, if the rotation-transmission ratio $\alpha/\beta$ from the tire 8a to the crank shaft 6 satisfies the following condition, the cleaner can run forward without the broom 10 leaving the cleaning surface 13 unswept:

$$\alpha/\beta\geqq\gamma(2\pi+\alpha)/L.$$

Figure 6:
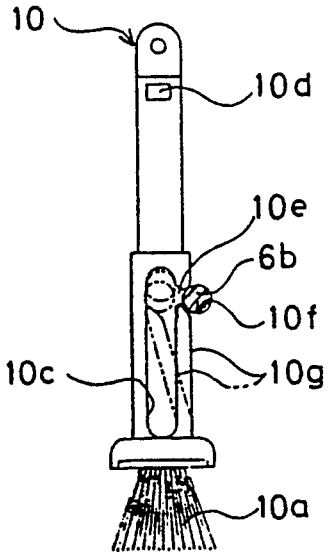

As shown in FIG. 6, the elongated slot 10c of the broom 10 is formed at its portion with a cut portion 10e, the open width of which is smaller than the diameter of the shaft portion 6b of the crank shaft 6. The cut portion 10e is formed at its end portion with a tapered surface 10f. When the shaft portion 6b is inserted along the tapered surface 10f from the cut portion 10e, an elastic part 10g divided by the cut portion 10e is elastically deformed to allow the shaft portion 6b to move forward into the elongated slot 10c. Thus, the shaft portion 6b is made freely movable within the elongated slot 10c.

As shown at (a) and (b) in FIG. 7, the engaging portion 10d at the upper end portion of the broom 10 is in abutment against the opening 11b of the supporting portion 11. As a result, the length of downward protrusion of the brush 10a from the cleaner is regulated even if the cleaner is lifted up. The length of the downward protrusion of the brush 10a from the frames 2 and 3 is set equal to or smaller than a deformable height h of the brush 10a, as shown at (c) in FIG. 7.

Figure 8:
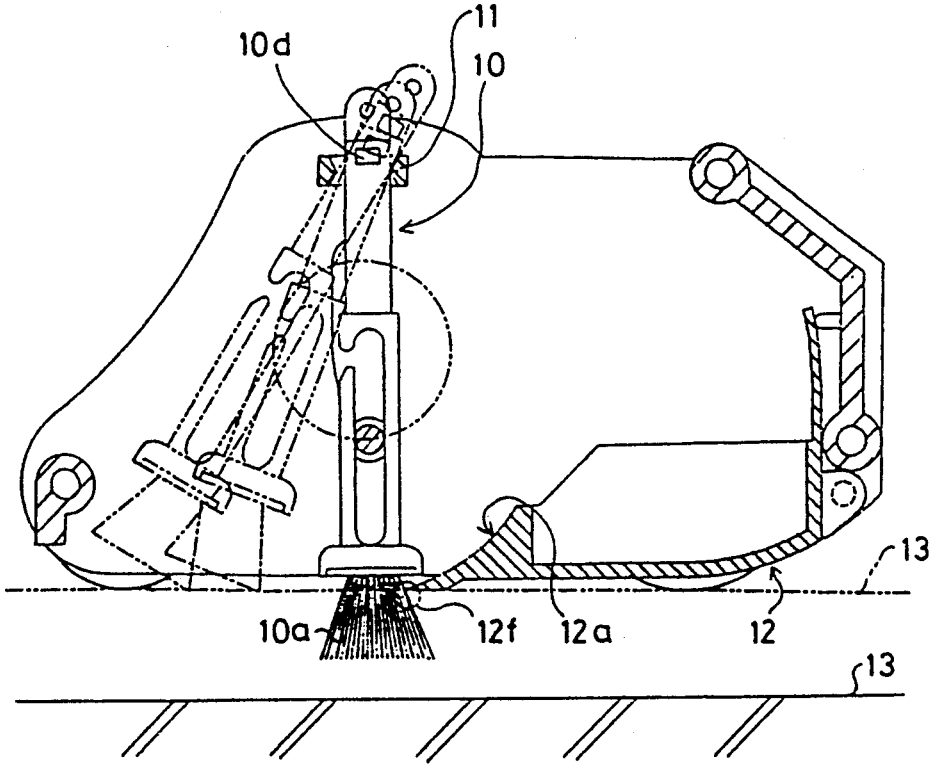

If the length of the downward protrusion of the brush 10a from the cleaner were larger than the deformable height h of the brush 10a when the cleaner is lifted up, as shown in FIG. 8, the brush 10a would move more than necessary and come into abutment against the leading edge 12f of the dust case 12 so that it could not move and disable the broom 10.

FIGS. 9 to 16 show other embodiments for explaining the structure for pushing the brush 10a onto the cleaning surface 13 so as to enhance the cleaning ability of the cleaner.

Figure 9:
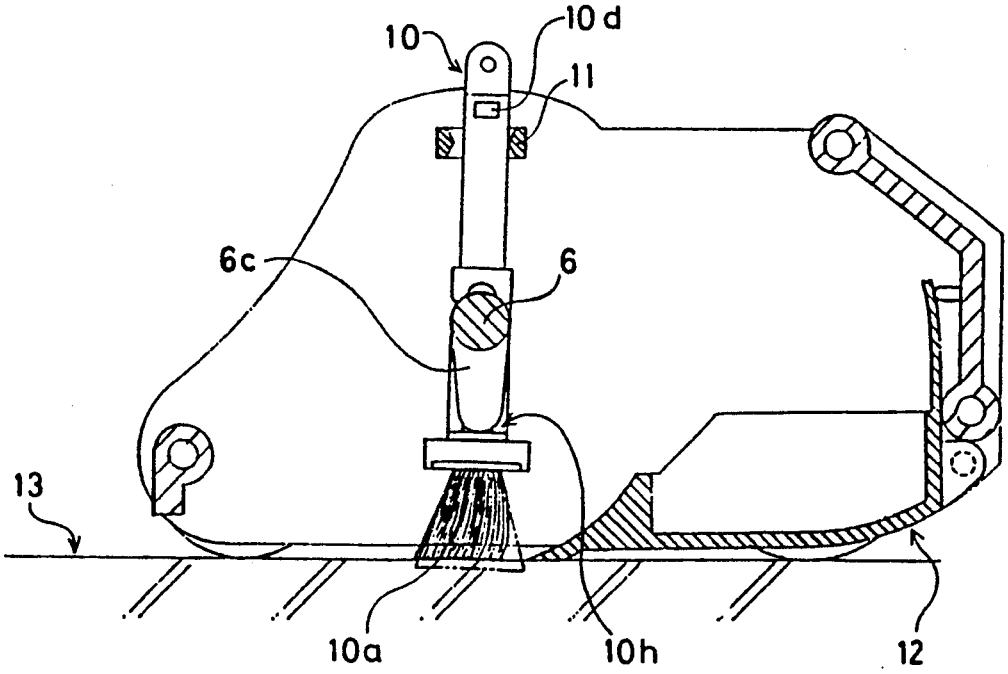

In the embodiment shown in FIGS. 9 and 10, the lower end face of an arm portion 6c of the crank shaft 6 can push the lower end portion 10h of the broom grasp portion when the broom 10 is in its lowermost position. By this push, the brush 10a is forcibly deformed by the cleaning surface 13.

Figure 11:
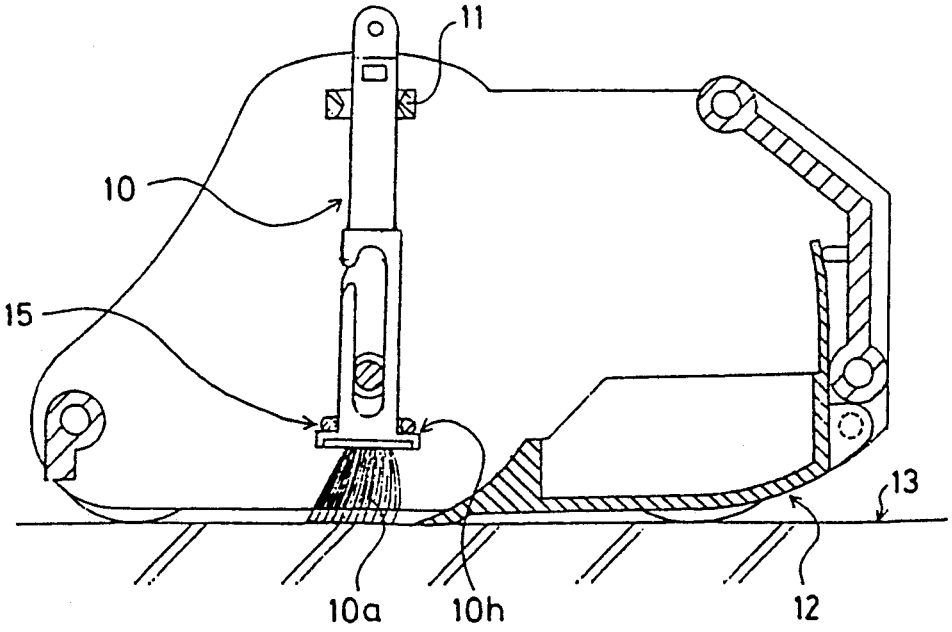
Figure 12:
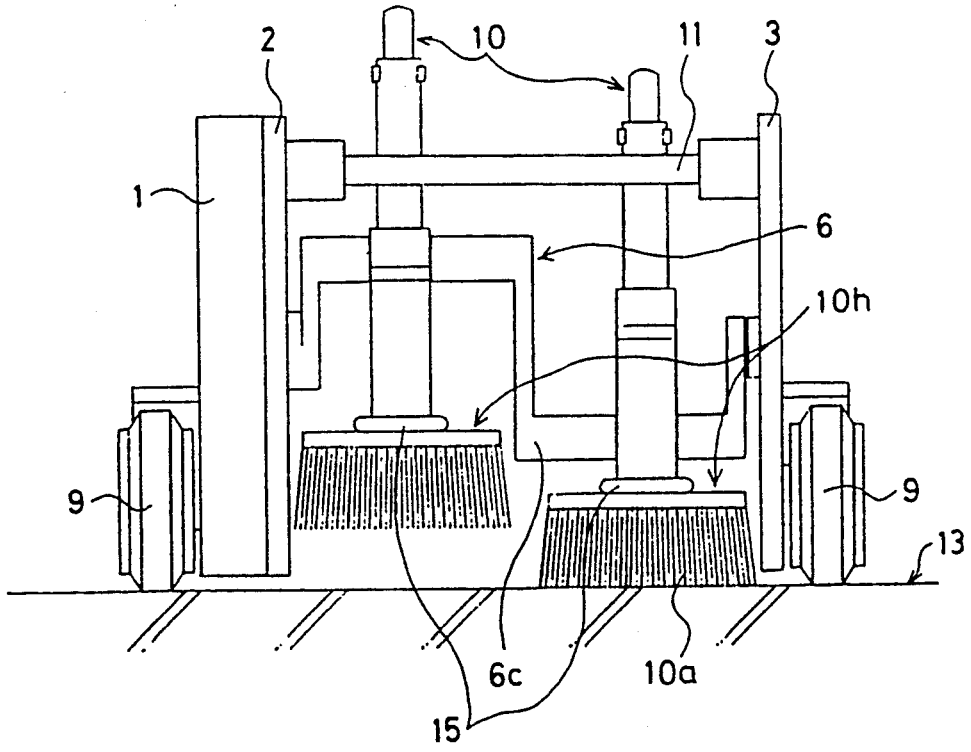

In the embodiment shown in FIGS. 11 and 12, the broom grasp portion is equipped at its lower end portion 10h with a ring-shaped weight 15. By this weight 15, the brush 10a is pushed and deformed onto the cleaning surface 13.

Figure 13:
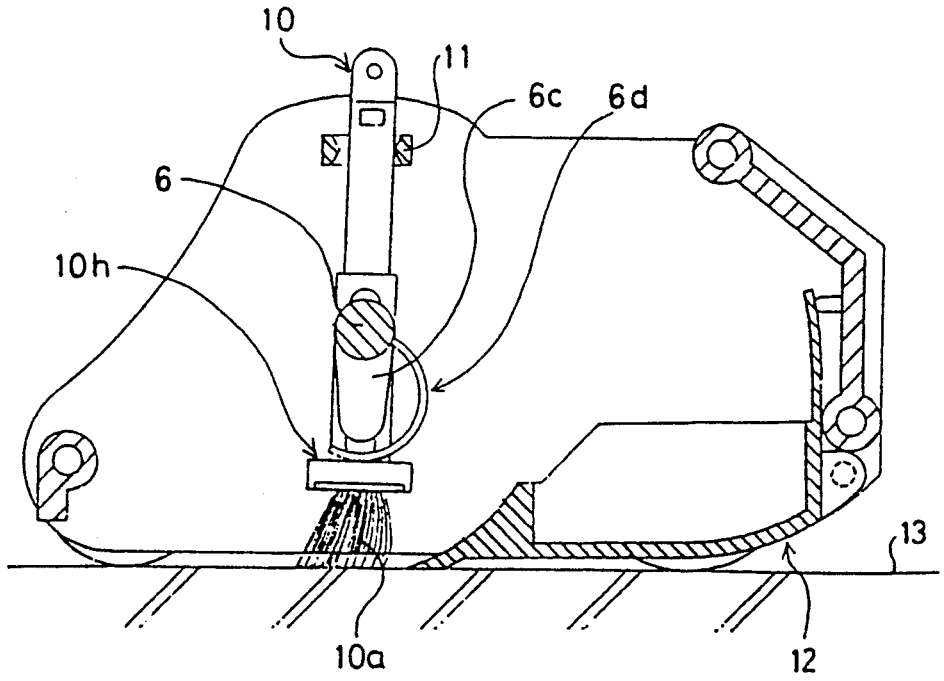
Figure 14:
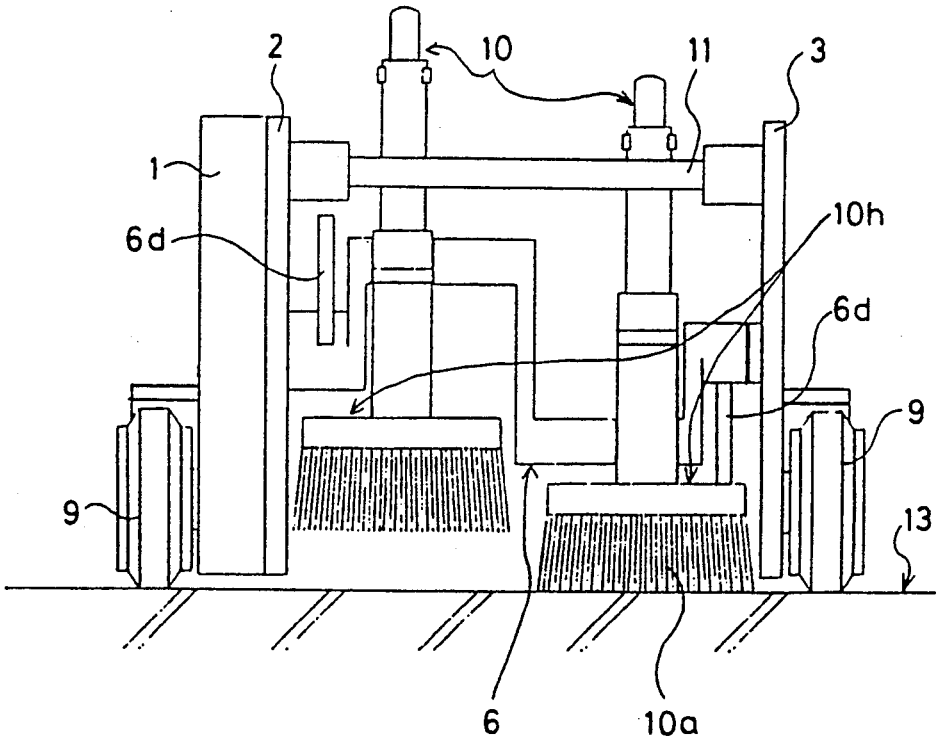

In the embodiment shown in FIGS. 13 and 14, the crank shaft 6 is formed integrally with a resilient portion 6d which is enabled to push the lower end portion 10h of the grasp portion when the broom 10 is in its lowermost position. The brush 10a is pushed and deformed onto the cleaning surface 13 by the resilient force of the resilient portion 6d.

Figure 15:
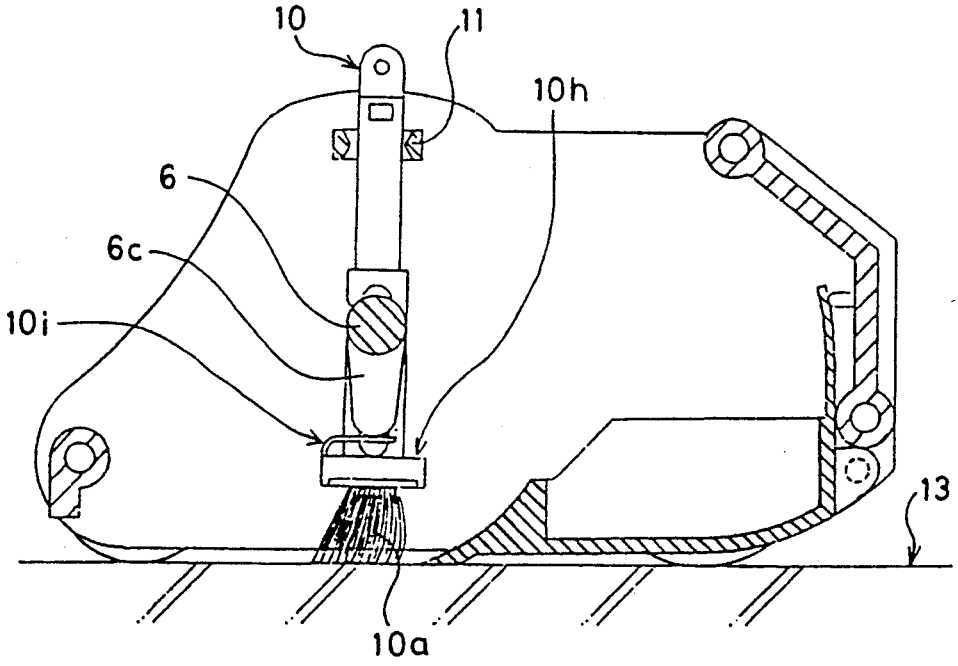
Figure 16:
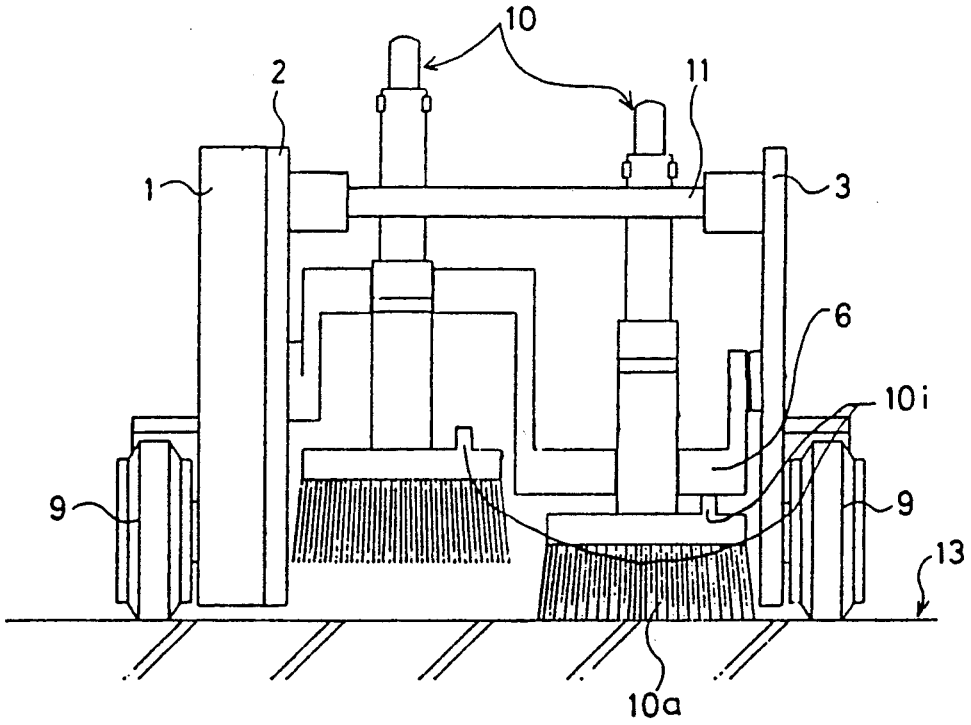

In the embodiment shown in FIGS. 15 and 16, the lower end portion 10h of the broom grasp portion is formed integrally with a resilient portion 10i which is enabled to push the lower end face of the arm portion 6c of the crank shaft 6 when the broom 10 is in its lowermost position. The brush 10a is pushed and deformed onto the cleaning surface 13 by the resilient force of the resilient portion 10i.

Figure 17:
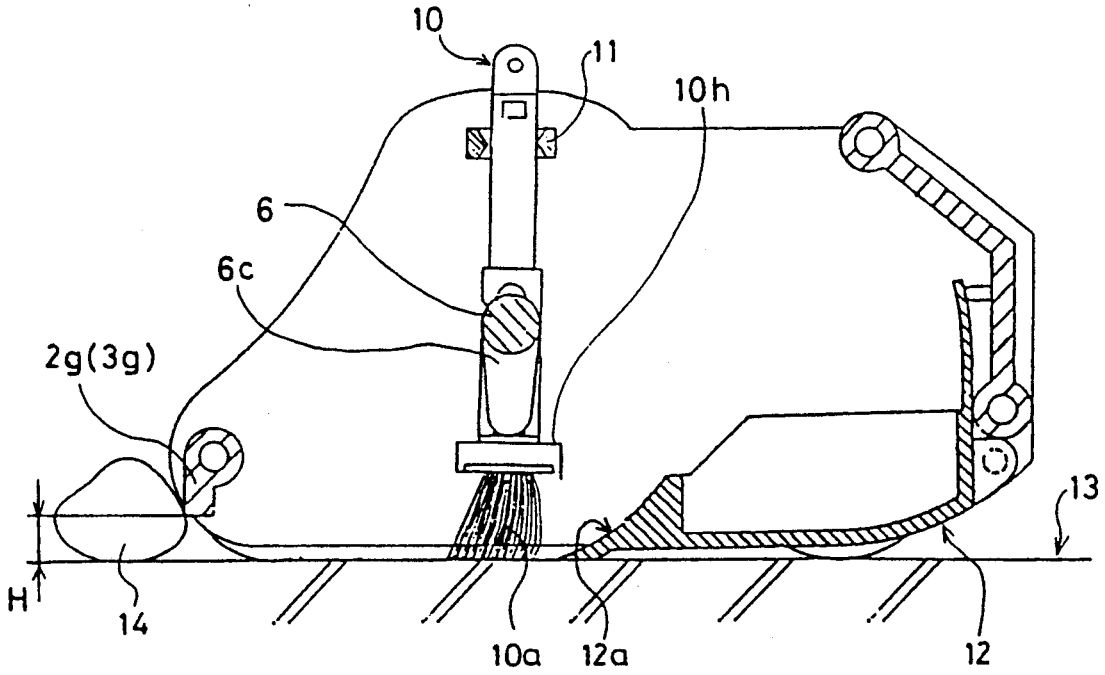
FIG. 17 is a sectional side elevation for explaining the selecting members.

The extending portions constituting the selecting members for selecting the height of the dust 14 will be described in the following with reference to FIG. 17.

The gap H between the extending portions 2g and 3g and the cleaning surface 13 is set at a level no more than the deformable height h (as indicated at (c) in FIG. 7) of the brush 10a, as has been described hereinbefore. In case the gap H is larger than the deformable height h of the brush 10a, the dust 14 would pass into the cleaner, if its height were larger than the height h, to jam the broom 10.

Figure 18:
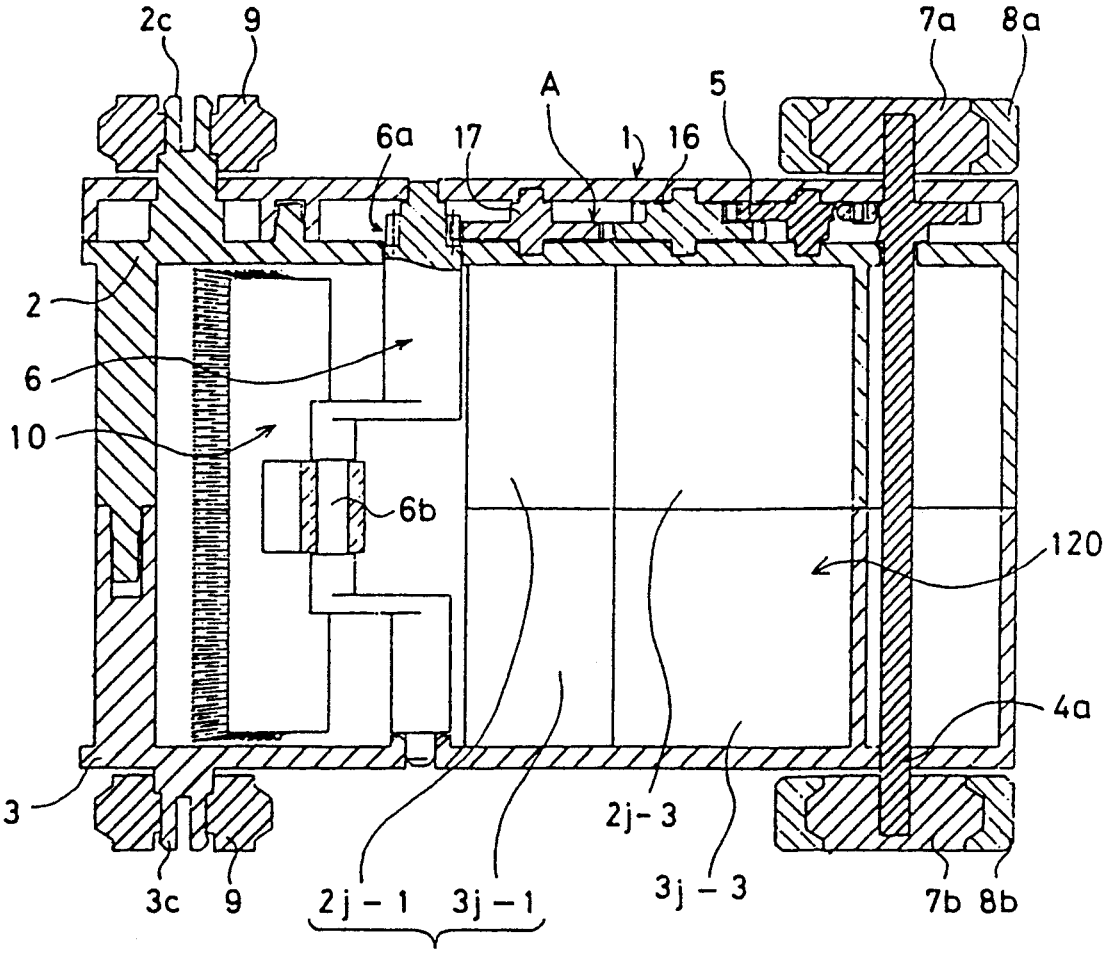
Figure 19:
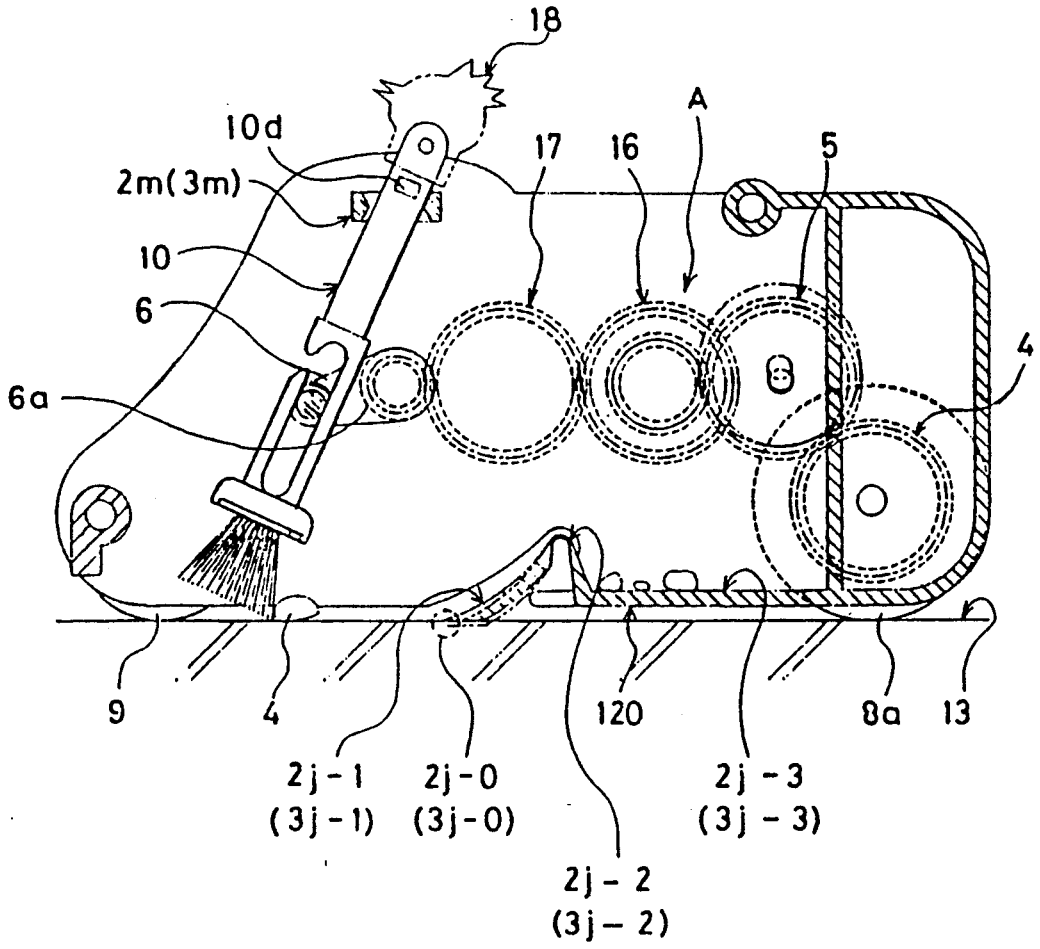
Figure 20:
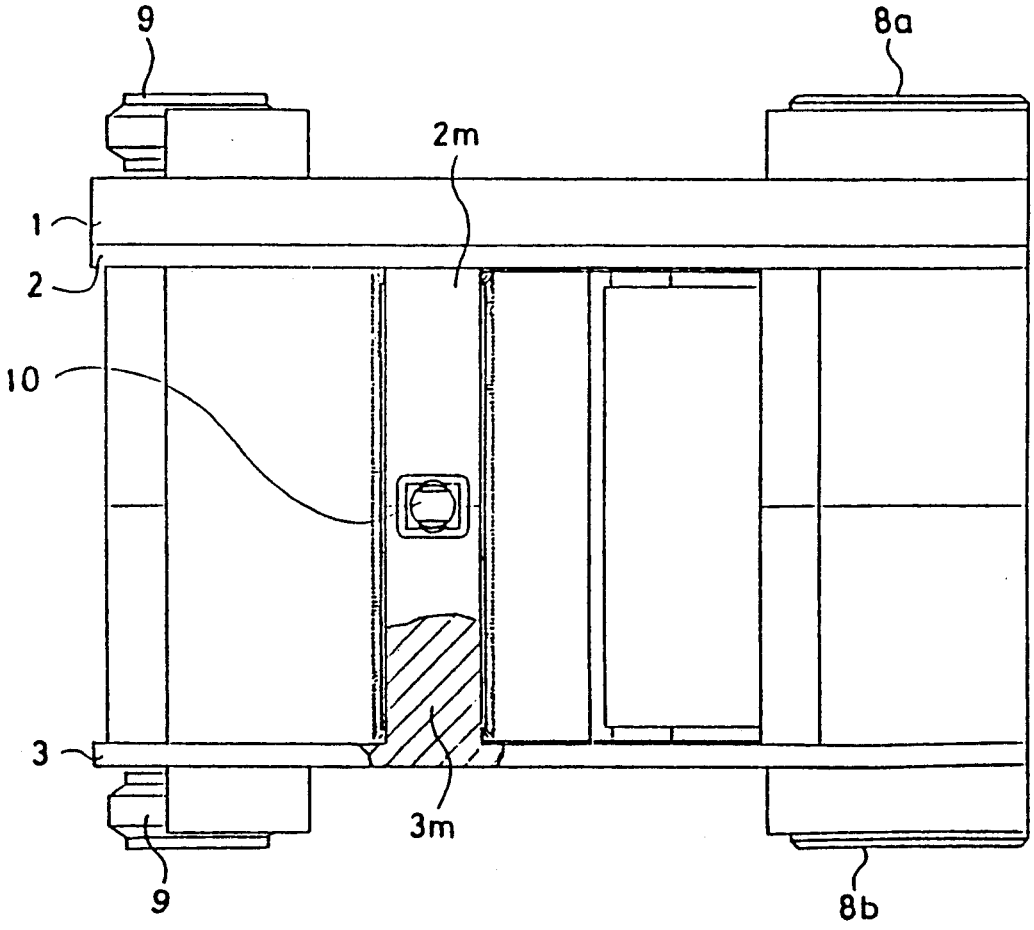

FIGS. 18 to 20 show an embodiment in which the dust case is formed integrally with the frames 2 and 3.

As shown in FIGS. 18 to 20, the shaft 4a of the drive gear 4 is supported by the frames 2 and 3. In the spacing between the supporting plate 1 and the frame 2, there is provided not only the clutch gear 5 meshing with the drive gear 4 but also a multiplying gear 16 and an idler wheel 17 which is in meshing engagement with the pinion 6a. These components constitute altogether the power transmission mechanism A.

A dust case 120 is formed integrally with the frames 2 and 3 and is composed of dust entrances 2j-1 and 3j-1 and dust chambers 2j-3 and 3j-3. Since thin portions 2j-2 and 3j-2 are formed between the dust entrances and the dust chambers, the dust entrances 2j-1 and 3j-1 are made so resilient that their leading edges 2j-0 and 3j-0 can resiliently contact with the cleaning surface 13.

The frames 2 and 3 are formed integrally with supporting portions 2m and 3m, respectively, which are joined to bear the upper end portion of the broom 10. On the upper end of the broom 10, there is mounted a movable decoration 18 such as a doll, as shown in FIG. 19.

Figure 21:
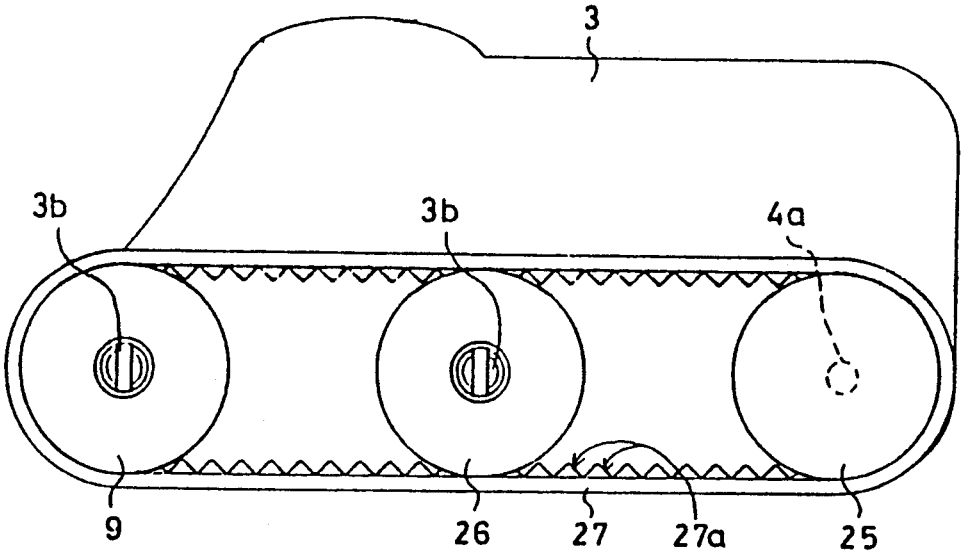
Figure 22:
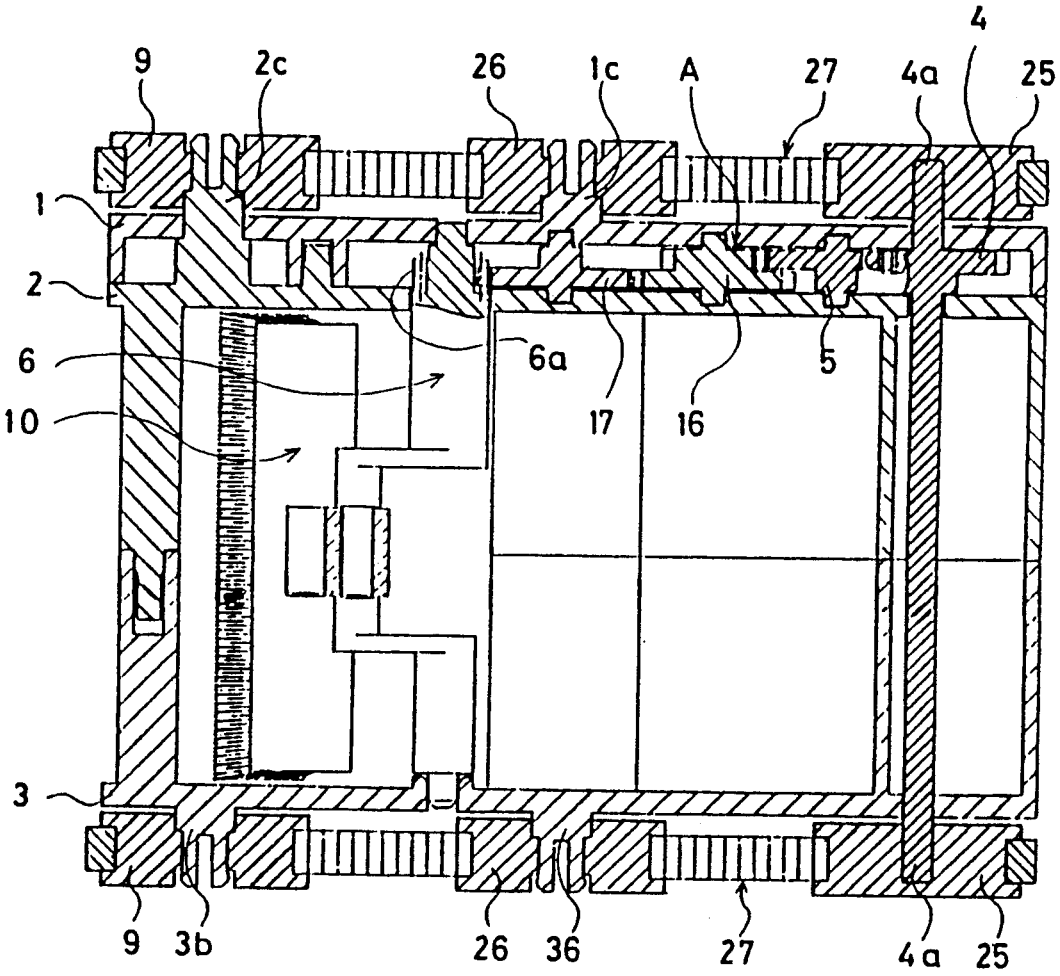

FIGS. 21 and 22 show another embodiment using belts in place of the tires.

As shown in FIG. 22, wheels 25 and 25 are press-fitted on the shaft 4a of the drive gear 4. The supporting plate 1 and the frames 2 and 3 are formed integrally with wheel shafts 1c and 2c, and 3b and 3b, respectively, to which are snapped wheels 9 and 9, and 26 and 26. A pair of endless belts 27 and 27 are made to run on the individual wheels 9 and 9, 25 and 25, and 26 and 26. The belt 27 is formed with teeth 27a, as shown in FIG. 21, which mesh the teeth (not shown) formed in the individual wheels 9, 25 and 26. As a result, these wheels 9, 25 and 26 can be rotated altogether through the belt 27. Since the two belts 27 and 27 have a large area to contact the cleaning surface 13, the wheels 9, 25 and 26 are rotated without fail to transmit their rotation through the power transmission mechanism A to the crank shaft 6.

Figure 23:
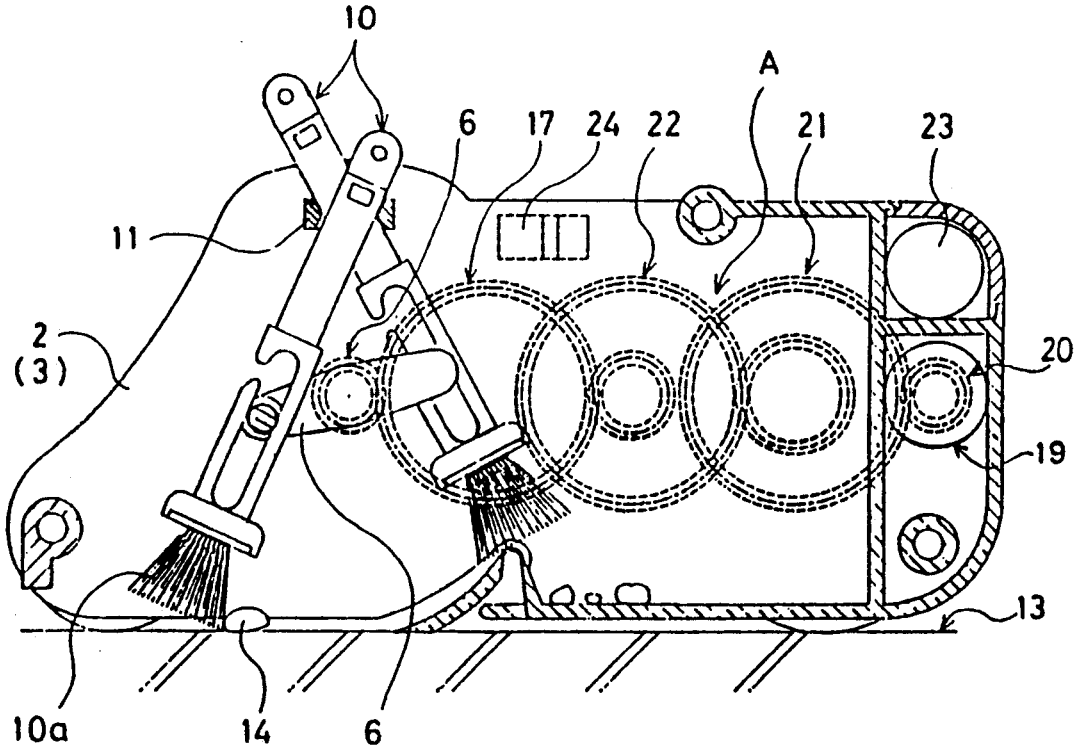
Figure 24:
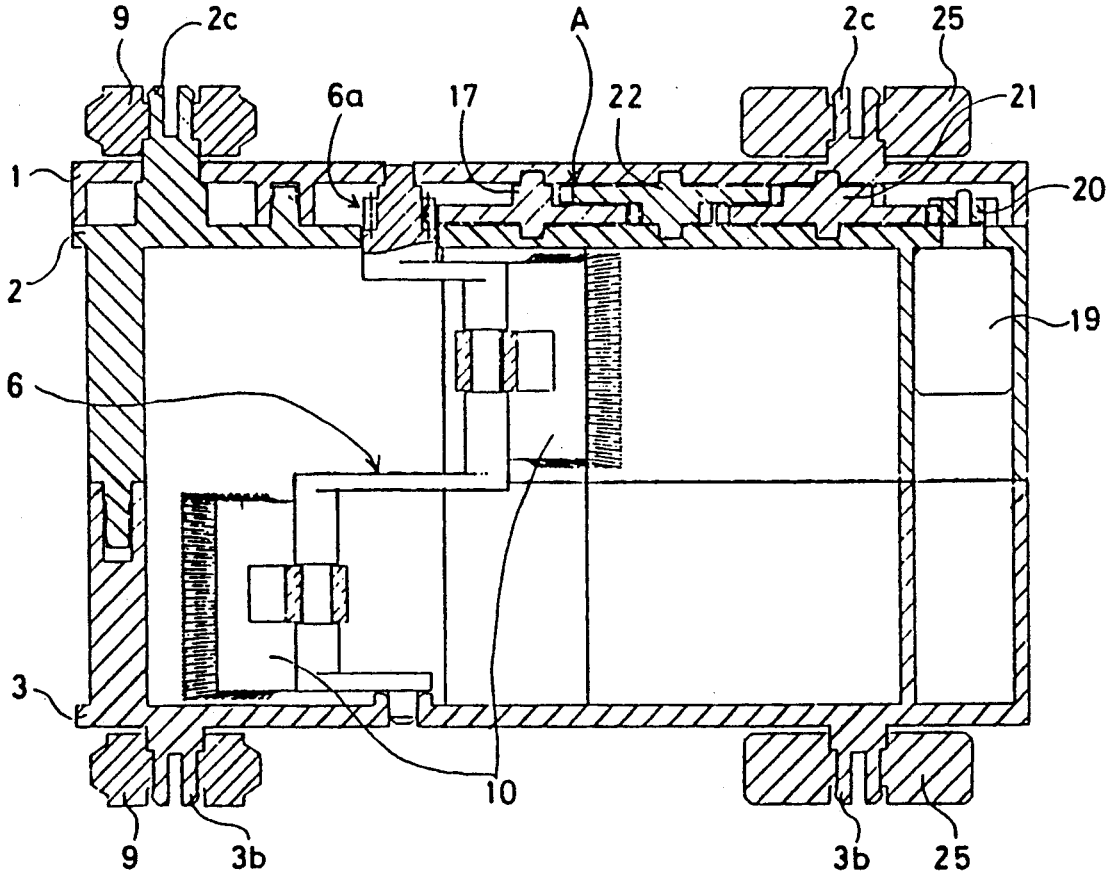

FIGS. 23 and 24 show another embodiment in which the rotational drive of the crank shaft 6 is accomplished not manually but by using a drive motor.

As shown in FIGS. 23 and 24, the frames 2 and 3 are equipped with a battery 23 and a drive motor 19 to be energized by the battery. A pinion 20 is press-fitted on the output shaft of the drive motor 19. This pinion 20 meshes sequentially with gears 21 and 22, the idler 17 and the pinion 6*a*, thus constituting altogether the power transmission mechanism A. The frame 2 is equipped at its side portion with a switch 24 for operating the drive motor 19 when it is turned on. Since, in this case, the wheels 9 and 25 are not connected with the crank shaft 6, the clutch means is dispensed with.

As has been described hereinbefore, according to the desk top cleaner of the present invention, the cleaning operation is accomplished by the use of the broom so that its performance will not be deteriorated even after a long time of use. The broom itself presents rhythmical motions for sweeping the dust into the dust case so that the cleaner is made enjoyable to give the user a pleasant feeling.

More rhythmical motions can be exhibited if a plurality of brooms are mounted in the extending direction of the crank shaft.

Even if the cleaner is backed, the clutch means interrupts the transmission of rotations from the wheels to the crank shaft. As a result, the broom is not rocked so that no dust is swept back to the cleaning surface.

Since, the rotation transmission ratio is set at the aforementioned value, the cleaner can be carried forward without the desk top being left unswept by the broom.

Since the broom and the crank shaft are connected by inserting the latter into the cut portions of the elongated slots of the former, the number of parts is reduced to facilitate the assembly of the cleaner, and the unnecessary upward movement of the broom is eliminated.

Since the broom is formed with the engaging portion, it is prevented from protruding more than necessary from the lower face of the frame, even if the cleaner body is lifted up. Thus, it is possible to avoid the disadvantage of disabling the broom from being rocked or damaged.

Since the brush at the lower end portion of the broom and the dust entrance at the leading edge of the dust case are pushed to contact with the cleaning surface, the dust can be smoothly swept into the dust case by the broom.

Since the dust having a size to be swept in is selectively brought into the cleaner by the selecting members, any oversize dust will not be caught to disable the operation so that the cleaning operation can be accomplished stably and reliably.

If the belts are made to run on plural wheels, the contact area between the belts and the cleaning surface is enlarged to ensure the transmission of the forward force of the cleaner to the crank shaft.

Although the present invention has been described through specific terms, it should be noted here that the described embodiments are not necessarily exclusive and that various changes and modifications may be imparted thereto without departing from the scope of the invention, which is limited solely by the appended claims.

What I claim is:

1. A desk top cleaner for cleaning an underlying surface comprising:

a frame having a support means;

a crank shaft rotatably mounted on said frame;

broom means having a lower portion formed with a brush and an upper portion engageable by said support means;

operable means operably disposed between said broom means and said crank shaft such that rotation of said crank shaft effects back and forth movement of said broom means relative to said frame to thereby effect sweeping of said underlying surface;

drive means on said frame for rotating said crank shaft;

dust receiving means on said frame for receiving the dust swept by said broom means, said dust receiving means having a dust entrance portion which is made of a resilient material to resiliently engage said underlying surface to be swept;

said dust receiving means comprising a dust receiving chamber having a dust entrance portion, said dust receiving chamber having a forward part and a rear part with said forward part being ahead of the rear part considered in the direction of movement of the desk top cleaner when it is effecting its cleaning action, said dust entrance portion being disposed at said forward part;

pivot means pivotably mounting said dust receiving means on said frame; and resilient engaging means between said dust receiving chamber and said frame for resiliently urging said dust receiving chamber in a pivotal direction in which said dust entrance portion resiliently engages said underlying surface to be swept, said resilient means being disposed at said rear part of said dust receiving chamber, said resilient means comprising resilient portions on said dust receiving chamber, and projections on said frame engaged by said resilient portions.

* * * * *